US006667725B1

(12) United States Patent
Simons et al.

(10) Patent No.: US 6,667,725 B1
(45) Date of Patent: Dec. 23, 2003

(54) RADIO FREQUENCY TELEMETRY SYSTEM FOR SENSORS AND ACTUATORS

(75) Inventors: Rainee N. Simons, North Olmsted, OH (US); Felix A. Miranda, Olmsted Falls, OH (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 10/196,391

(22) Filed: Aug. 20, 2002

(51) Int. Cl.[7] ..... H01Q 1/36; G08B 13/14

(52) U.S. Cl. ..... 343/895; 343/741; 343/742; 343/866; 340/572.1; 340/572.7

(58) Field of Search ..... 343/741, 742, 343/866, 867, 700 MS, 895; 340/572.1, 572.7, 825.54; 424/633; 333/66

(56) References Cited

U.S. PATENT DOCUMENTS 3,852,755 A 12/1974 Works et al.
4,857,893 A 8/1989 Carroll
5,257,033 A * 10/1993 Roche ..... 343/742
5,300,875 A 4/1994 Tuttle
5,335,361 A 8/1994 Ghaem
5,440,300 A 8/1995 Spillman, Jr.
5,461,385 A 10/1995 Armstrong
5,493,312 A * 2/1996 Knebelkamp ..... 343/860
5,621,913 A 4/1997 Tuttle et al.
5,825,291 A * 10/1998 Platt et al. ..... 340/572.7
5,826,178 A * 10/1998 Owen ..... 455/193.1
5,970,393 A 10/1999 Khorrami et al.

* cited by examiner

*Primary Examiner*—Tan Ho
(74) *Attorney, Agent, or Firm*—Kent N. Stone

(57) ABSTRACT

The present invention discloses and teaches apparatus for combining Radio Frequency (RF) technology with novel micro-inductor antennas and signal processing circuits for RF telemetry of real time, measured data, from microelectromechanical system (MEMS) sensors, through electromagnetic coupling with a remote powering/receiving device. Such technology has many applications, but is especially useful in the biomedical area.

11 Claims, 6 Drawing Sheets

RADIO FREQUENCY TELEMETRY SYSTEM FOR SENSORS AND ACTUATORS

ORIGIN OF THE INVENTION

The invention described herein was made by employees of the United States Government and may be manufactured and used by or for the Government, for Government purposes, without the payment of any royalties thereon or therefore.

BACKGROUND OF THE INVENTION

1. Field of the Invention

The present invention generally relates to combining Radio Frequency (RF) technology with novel micro-inductor antennas and signal processing circuits for RF telemetry of real time, measured data, from microelectromechanical system (MEMS) sensors, through electromagnetic coupling with a remote powering/receiving device. Such technology has many applications, but is especially useful in the biomedical area.

2. Description of the Prior Art

The prior art teaches capacitive sensors and switches that may be embedded within apparatus to perform remote sensing functions. However, the devices of the prior art are relatively complicated in structure and require the presence of a directly coupled power source. For example see the following U.S. Pat. Nos. 3,852,755; 4,857,893; 5,300,875; 5,335,361; 5,440,300; 5,461,385; 5,621,913; and 5,970,393.

BRIEF SUMMARY OF THE INVENTION

The present invention teaches a microminiaturized inductor/antenna system for contact-less powering of an oscillator circuit providing an RF telemetry signal from biomicroelectromechanical (bio-MEMS) systems, sensors, and/or actuators. A miniaturized circuit inductor coil is printed on a dielectric substrate. The inductor coil behaves both as an inductor, which acts to charge a capacitive device as well as an antenna for transmitting a RF signal indicative of the level of charge of the capacitive device.

The micro-miniature circuit operates in two modes. In the first mode, the inductance coil forms a series resonant circuit with the capacitance of a capacitive MEMS device such as a pressure-sensing diaphragm of a MEMS pressure sensor device. In the second mode, the capacitive device produces an oscillating electrical current flow through a planar printed inductor coil. The inductor coil is equivalent to a helical antenna and hence loses power through RF radiation from the inductor. A remote RF receiving device may be used to receive the RF radiation, from the inductor coil, as a RF telemetry signal. The functional operation begins when an electromagnetic coupling energizes the circuit with a remote-transmitting device followed by oscillation of the circuit. Thus there is no direct or hard connection to the circuit by any power source.

DETAILED DESCRIPTION OF THE INVENTION

Figure 1:
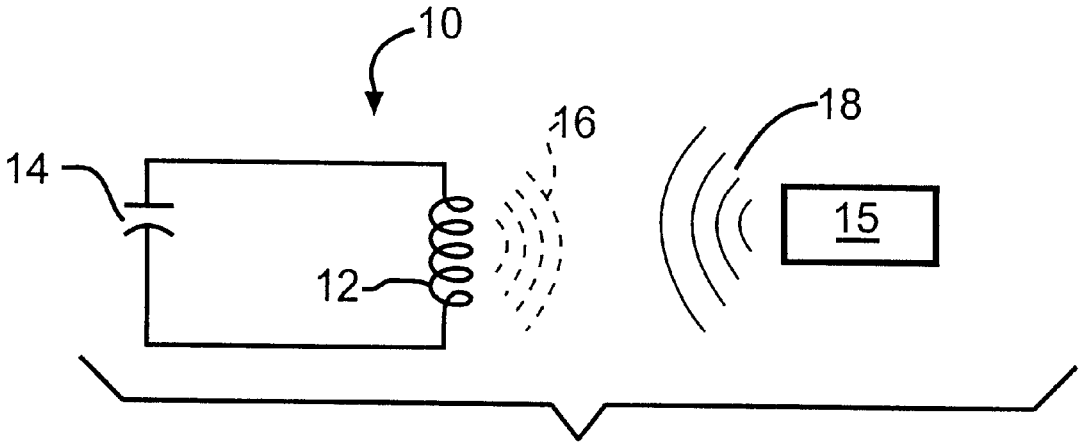
FIG. 1 presents a schematic diagram of the electrical oscillator circuit embodied in the present invention.

FIG. 1 illustrates a simple oscillator circuit 10 comprising an inductor coil 12 and a capacitor 14. If inductor 12 is subjected to a magnetic field 18 from a remote electromagnetic source 15, an electrical current is created within inductor 12, which will flow to and charge capacitor 14. Upon capacitor 14 becoming fully charged, current flow from induction coil 12 will stop. When the magnetic field 18 is removed, current will flow from capacitor 14 energizing inductor 12. Upon capacitor 14 transferring all of its energy, minus losses, to inductor 12, the electromagnetic energy now stored within inductor 12 will once again flow back to capacitor 14 thereby recharging capacitor 12. This "oscillating" process will continue until the total electromagnetic energy within circuit 10 dissipates. During this oscillation, inductor 12 will radiate RF energy 16 at a frequency determined by the properties of capacitor 14 and inductor 12.

Figure 2:
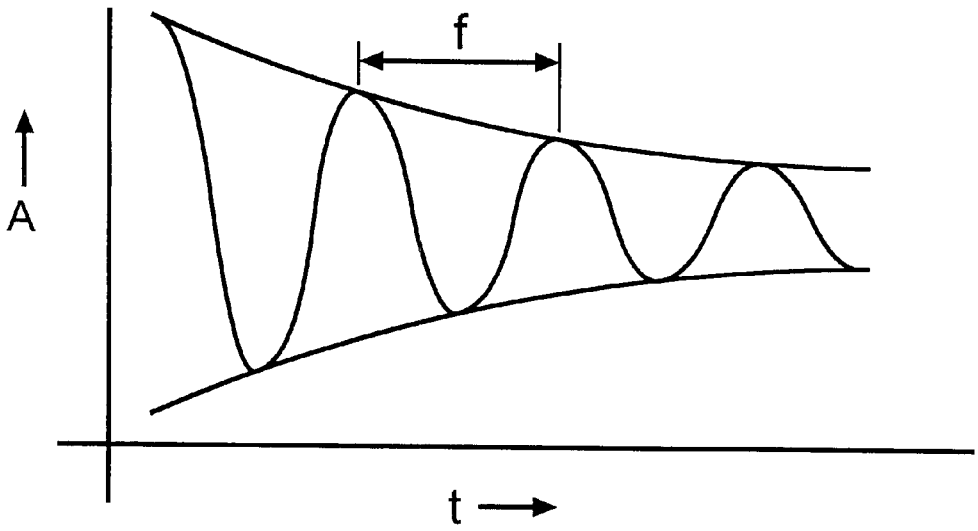
FIG. 2 presents a curve showing the amplitude and frequency, as a function of time, for the oscillating signal produced by the oscillator circuit illustrated in FIG. 1.

FIG. 2 illustrates the RF signal transmitted from inductor 12, as a function of time t, after the magnetic field 18 has been removed. As illustrated in FIG. 2, the amplitude A of the RF signal decays as a function of time t, however, the frequency f of the signal remains constant.

Figure 2A:
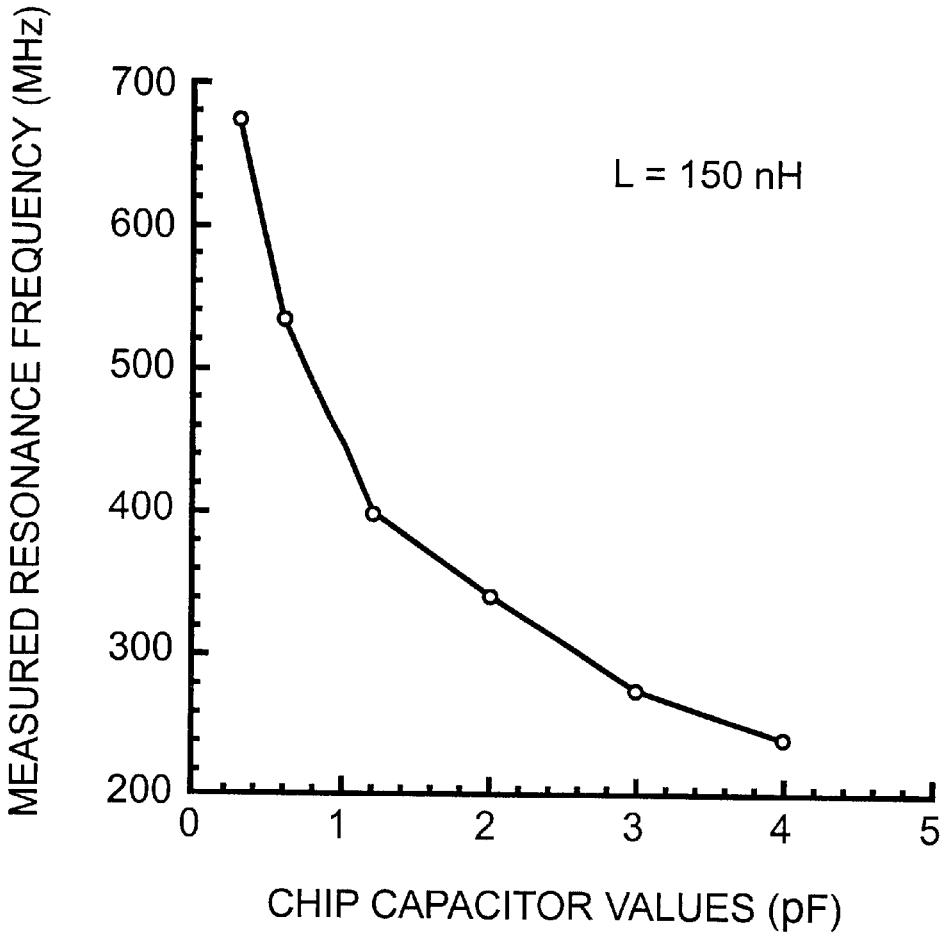
FIG. 2A presents a plot of measured resonance frequency vs. chip capacitor values for an oscillating circuit having a 150 nH inductor.

FIG. 2A presents a plot of the measured RF signal frequency as a function of capacitor values for an oscillating circuit having a 150 nH inductor coil.

Figure 3:
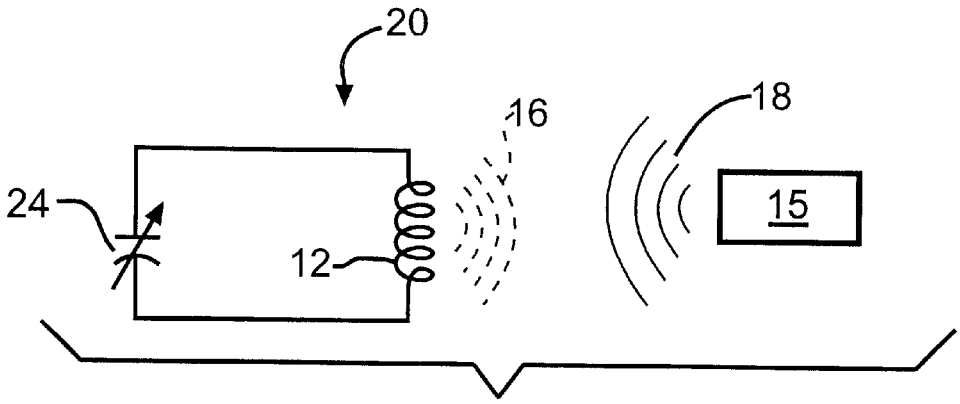
FIG. 3 presents a similar electrical circuit as shown in FIG. 1 having a microelectronic capacitive sensor device therein.

Referring now to FIG. 3, a similar circuit 20, as that shown in FIG. 1, is illustrated wherein the capacitor 14 has been replaced with a "microelectromechanical (MEMS) capacitive sensing device 24 such as a MEMS pressure sensing device. MEMS pressure sensing device 24 may be placed at a pressure sensing location where real time pressure measurement is desired. When a pressure measurement is desired to be taken, a remote magnetic field 18, from electromagnetic source 15, is used to energize inductor 12 which causes an electrical current to flow from inductor 12 to MEMS pressure sensor 24. Pressure sensor 24 will thus be charged to the limit of its capacitance which is a function of the pressure that sensor 24 is measuring at that time.

Thus circuit 20, illustrated in FIG. 3, represents a "contact less" MEMS pressure measuring system, requiring no directly connected power source such as a battery etc. Circuit 20, is energized by a remotely generated magnetic field 18 from electromagnetic source 15, acting through inductor 12, thereby charging capacitive sensor 24 to an electrical energy state commensurate with the real time pressure being measured by sensor 24.

Circuit 20 has many MEMS applications where a continuous pressure read-out is not necessarily required but where a periodic check of real time pressure is desired. Such an application may be particularly useful in in-vivo medical applications.

Figure 4:
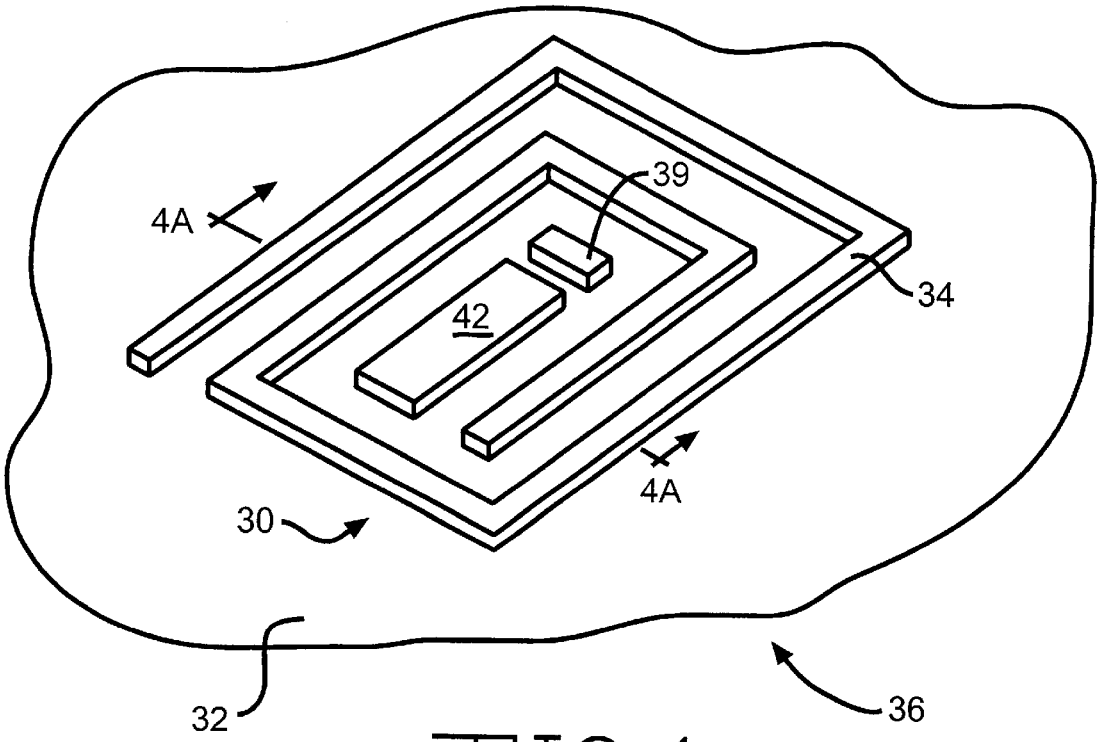
FIG. 4 presents a, greatly enlarged, schematical illustration of a pressure sensing/transmitting MEMS microchip embodying the present invention.
Figure 4A:
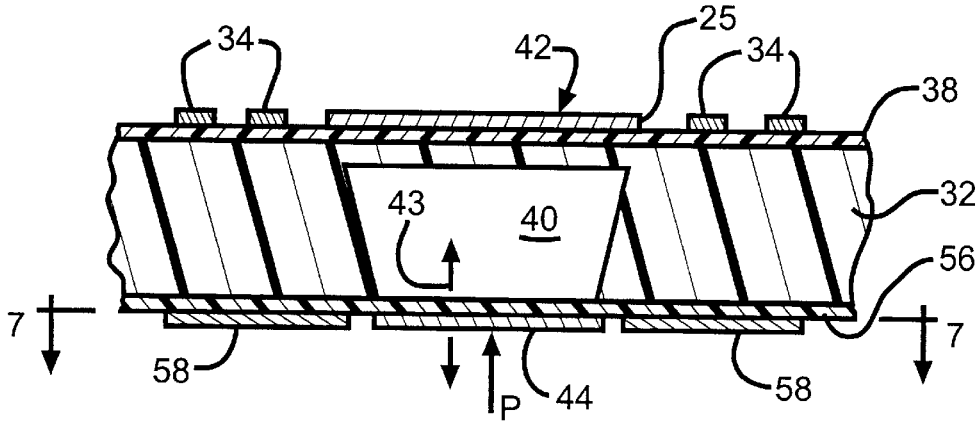
FIG. 4A presents an elevational crossection taken along line 4A—4A in FIG. 4 having a single micro capacitive pressure sensor.

FIG. 4 presents a, greatly enlarged, schematic illustration of a MEMS capacitive pressure sensing device 36 in accord with the present invention. A suitable substrate material 32, such as silicon, has MEMS capacitive pressure sensor circuit 30 attached thereto. Encircling MEMS pressure sensor 42 is a planar micro-inductor coil 34. Additionally any other desired solid state circuits including microprocessor 39 might be added to the chip and linked to circuit 30.

Thus when a real time, instantaneous, pressure measurement is desired, an electromagnetic field may be directed toward inductor coil 34. Inductor coil 34 will charge capacitive pressure sensor 42 to an electrical energy level commensurate with the capacitance of sensor 42 at the time inductor coil 34 is energized. Upon removal of the electromagnetic field from inductor coil 34, the electrical energy stored within MEMS pressure sensor 42 will now energize inductor coil 34. The oscillator circuit formed by inductor coil 34 and capacitive pressure sensor MEMS 42 will now radiate a measurable RF signal proportionate to the capacitive value of MEMS pressure sensor 42.

Typical overall dimensions of the inductor/antenna coil 34 encircling the MEMS pressure sensor 42 and the solid state circuits 39 may be as small as 1 mm×1 mm. Substrate 32 may be a high resistivity silicon that will reduce the attenuation of the RF signal radiated from the inductor coil. Metalization of inductor coil 34 may be chrome/gold approximately 150 Angstroms and 2 microns thick respectively.

Figure 8:
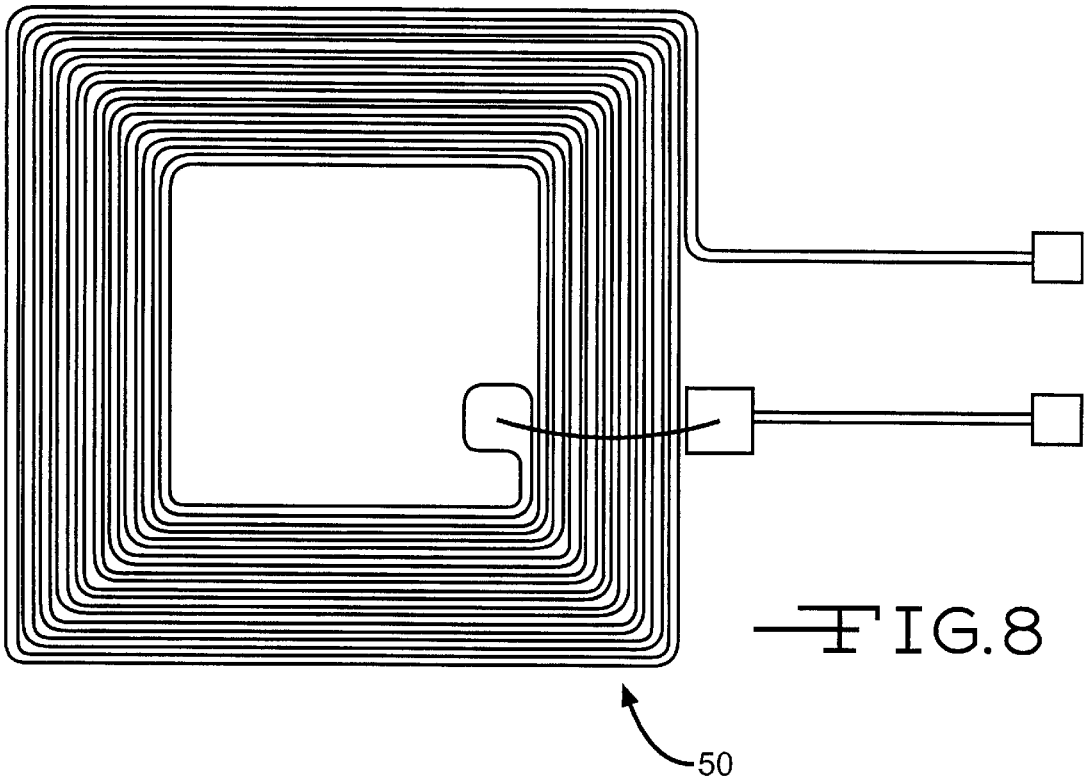
FIG. 8 presents a greatly enlarged view of a square, planar, inductor coil suitable for use with the present invention.

Although FIG. 4 illustrates one and one half loops for coil 34, a more typical embodiment would comprise ten or more loops as illustrated in FIG. 8. The number of inductor coil loops will be dependent upon the range of capacitance values selected for MEMS pressure sensor 42 and the desired RF transmittal frequency of the installation.

Inductor coil 34 serves both as an inductor and as an antenna whereby coil 34 may operate in two modes. In the first mode, or charging mode, inductor coil 34 forms a series resonant oscillator circuit with the pressure measuring diaphragm of MEMS pressure sensor 42, whereby the capacitance of MEMS pressure sensor 42 will change in proportion to the pressure being applied to its pressure sensitive diaphragm.

Figure 5:
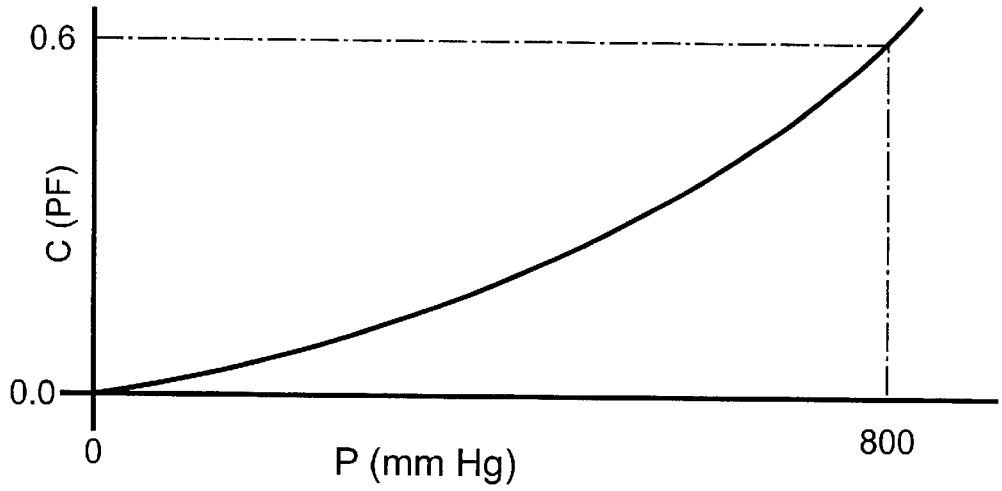
FIG. 5 presents a graphical plot of capacitance vs. pressure for a typical microelectronic capacitive pressure sensor.

In the second mode, or transmitting mode, inductor coil 34 serves as an antenna and radiates measurable RF energy at a frequency determined by the capacitance level of MEMS pressure sensor 42. FIG. 5 presents a representative plot of capacitance vs. pressure for a typical MEMS capacitive pressure sensor.

FIG. 8 illustrates a planar, inductor coil 50 suitable for use in pressure sensor circuit 30. Inductor coil 50 comprises 10 turns each turn having a strip width of 15 microns and a gap width of 10 microns. The overall size of coil 50 approximates a 1,000 micron square.

Referring to FIGS. 4 and 5, the preferred embodiment of the present invention will be described. MEMS pressure sensor 42 is formed upon a high resistivity silicon wafer 32 by etching cavity 40 out of wafer 32 as illustrated in FIG. 5. A "Spin-On-Glass" (SOG) coating 38 is applied to the top surface of silicon chip 32, upon which a first, rigid, capacitor plate 25 and planar inductor coil 34 are applied thereon, carefully positioning capacitor plate 25 directly over cavity 40. A second, suitable membrane 56 comprising a tri-layer of $SiO_2/Si3N_3/SiO_2$ 700 Å/3000 Å/4000 Å is applied over the bottom of wafer 32 having a second, pliable, pressure sensing capacitor plate 44 thereon. Capacitor plate 44 is carefully positioned opposite plate 42 and extends over cavity 40 as illustrated in FIG. 5. Parallel plates 25 and 44 cooperate to form a microminiature capacitor with capacitor plate 44 exposed to the pressure being measured. As pressure is applied to plate 44, plate 44 will necessarily yield in proportion to the applied pressure as indicated by arrow 43. As the distance between plate 25 and 44 changes, the capacitance of the microminiature capacitor will also, proportionately, change. See FIG. 5 for a representative plot of capacitance vs. measured pressure for typical MEMS pressure sensors.

Figure 7:
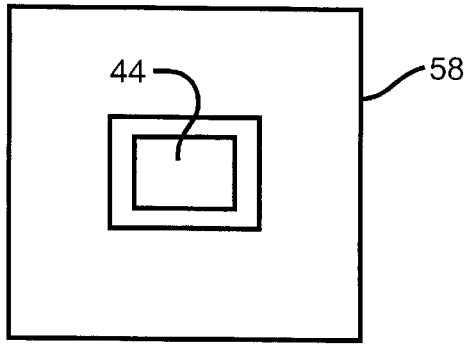
FIG. 7 is a plan view taken along line 7—7 in FIG. 5 showing a continuous ring type electrical ground plane.
Figure 10:
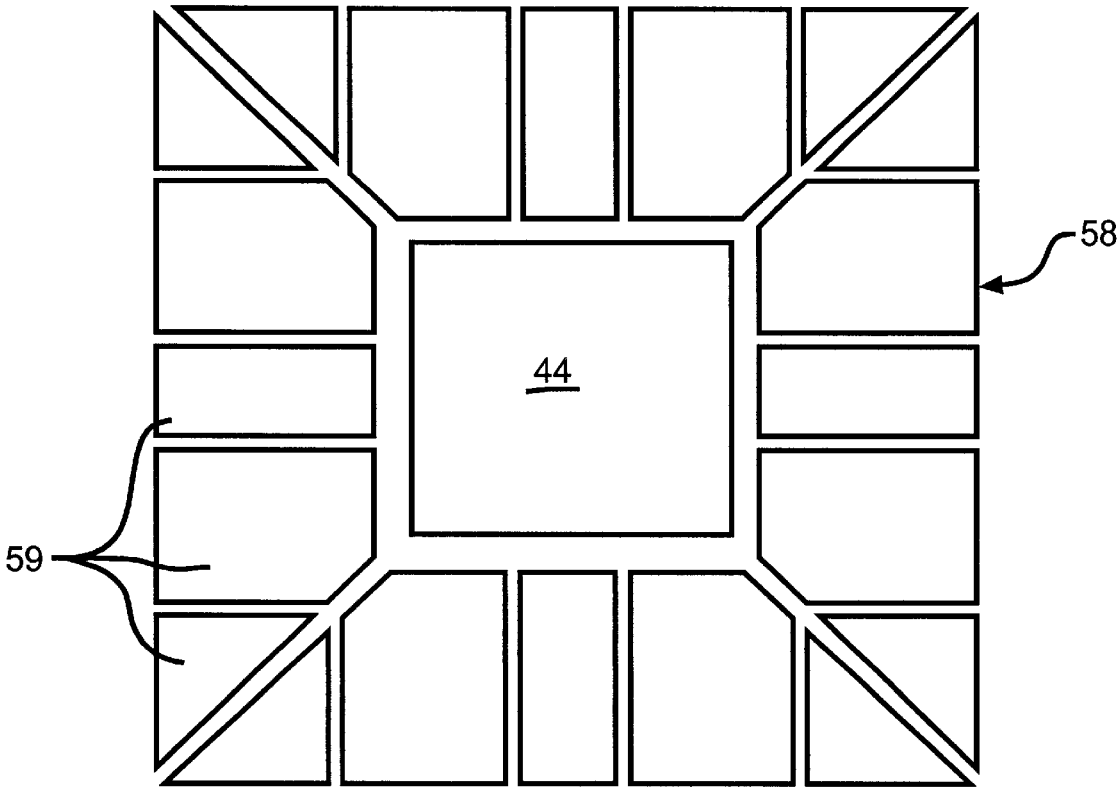
FIG. 10 presents a planar view, similar to that of FIG. 7 showing an alternative ground plane configuration suitable for use with the present invention.

The capacitor formed by plates 25 and 44 coupled with inductor coil 34 forms a micro miniature oscillating circuit similar to that described in FIG. 3. A planar electrical ground plane 58 may be added to the chip structure and coupled to inductor/antenna 34. For example a full ground plane may be used or a ring type ground plane illustrated in FIG. 7. Alternatively a serrated ground plane 59 as illustrated in FIG. 10 may be replace the ring type ground plane as illustrated in FIG. 7.

Table 6 presents measured quality factors (Q) for a planar inductor having a, full ground plane, a ring shaped ground plane, a serrated-ring shaped ground plane, and with no ground plane. It is seen from the data in Table 6 that a serrated ring ground plane out performs the other ground plane configurations.

Insulating layer 38 isolates the printed circuit from the substrate losses. Typically, the thickness of insulating layer 38 will be approximately 1 to 2 microns. Following application of insulating layer 38 the wafer 32 is patterned using photo resist and the inductor coil 34 is fabricated thereon using standard "lift-off" techniques. A suitable inductor coil thickness should lie within the range of 1.5 to 2.25 microns to minimize resistive losses in the circuit.

MEMS pressure sensors typically measure as little as 0.350 mm in width making them small enough for use in many in-vivo medical applications. For example, with one implanted MEMS pressure sensor it is possible to measure the internal pressure of body organs or wounds. With two MEMS pressure sensors it is possible to measure the pressure drop across an obstruction in an artery or newly implanted heart valve. With three MEMS sensors it is possible to characterize the flow across a long section of arteries, along the esophagus or through the small intestines.

Figure 6:
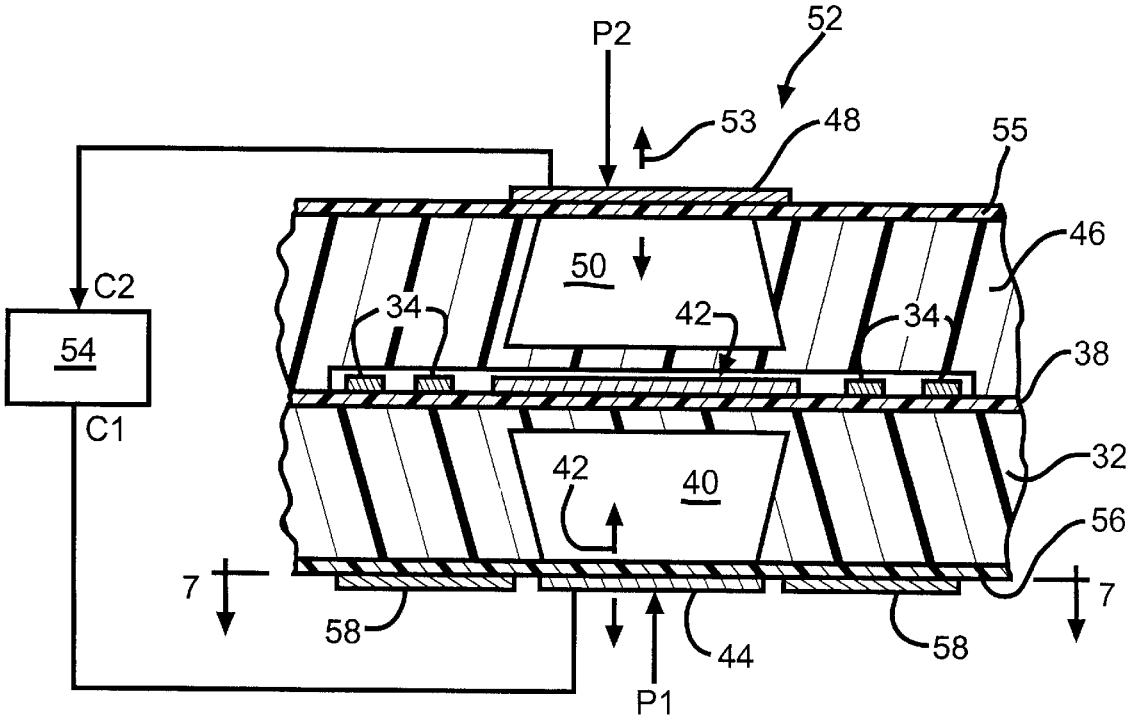
FIG. 6 presents a schematical elevational view, similar to that of FIG. 5 showing an alternate embodiment of the present invention having dual micro capacitive pressure sensors.
Figure 6A:
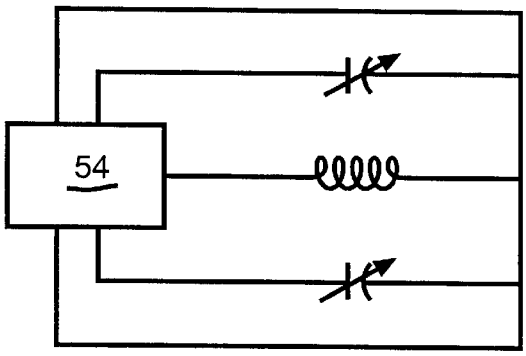
FIG. 6A presents an electrical schematic of the circuit diagram for the FIG. 6 embodiment.

FIG. 6 presents a schematical crossection, similar to that of FIG. 4, wherein a second silicon wafer 46 is applied atop wafer 32 sandwiching fixed capacitor plate 42 and planar inductor coil 34 therebetween as illustrated. A second cavity 50, similar to cavity 40, is etched into wafer 46 and positioned opposite cavity 40. A second membrane 55, including a flexible micro-miniature capacitor plate 48, similar to capacitor plate 44, is applied to the exposed surface of wafer 46 positioning capacitor plate 48 opposite capacitor plate 42. Capacitor plate 44 is exposed to a first pressure source P1 and capacitor plate 48 is exposed to a second pressure source P2. As capacitor plate 48 is exposed to varying pressure, capacitor plate 48 will yield in proportion to the pressure being applied thereto, as indicated by arrow 53 thereby varying the capacitance C2 between plate 42 and 48.

Where a pressure differential is the desired end product, capacitance values C1 and C2 may be read and compared (C1–C2) by a micro-integrating circuit 54 (see FIG. 6A). Integrating circuit 54 in combination with inductor coil 34 [(C1–C2)L] would then transmit an RF signal representing the differential pressure as measured by dual pressure measuring MEMS chip 52.

FIG. 6A presents the equivalent electrical circuit for the dual MEMS pressure sensors illustrated in FIG. 6. Integrator 54 measures the values of C1 (between capacitor plates 42 and 44) and C2 (between capacitor plates 42 and 48) and upon determining the difference therebetween establishes an oscillating circuit with inductor coil 34 whereby an RF signal is transmitted representing the pressure differential between P1 and P2.

Such a dual pressure measuring MEMS may find use in any number of applications. For example such a differential pressure measuring MEMS may particularly find use in measuring the pressure differential between the upper cambered surface and the lower non-cambered surface of a relatively thin experimental airfoil test section in a wind tunnel thereby eliminating the need to accommodate cumbersome wiring and/or tubing which otherwise may not be accommodated within such a test environment. A second example is a submersible, underwater transport vehicle for maintaining the structural integrity of the vehicle. A third example is a pressure vessel for a chemical processing plant. Similarly a multiplicity of single MEMS pressure sensors might be used.

A parametric study has been conducted to investigate the effect on quality factor (Q), of the above described microcircuits, by varying the width and separation between inductor coils; thickness of the SOG layer separating the inductor coils from the "High Resistivity Silicon" (HRSi) wafer; and the presence of a continuous, ring shaped, or serrated, ground plane.

Fabrication of the test chips comprised coating a high resistivity silicon wafer 32 with a thin insulating layer of SOG 38 to isolate the printed circuit from substrate losses. Typically the thickness of the insulating SOG layer 38 was about 1 to 2 microns. Following application of the SOG layer 38, the wafer was patterned using photo resist and the inductor coils were fabricated using standard "lift-off techniques. Inductor thickness was in the range of 1.5 to 2.25 microns to minimize resistive losses in the circuit. FIG. 8 illustrates a typical micro inductor/antenna circuit having ten square loop turns as used in the herein reported tests.

In conducting the parametric study, the strip width as well as the gap of the inductor coil 50 was varied within the range of 10 to 15 microns and was fabricated on two separate HRSI wafers. The circuits were characterized using on-wafer RF probing techniques and a Hewlett Packard Automatic Network Analyzer (HP 8510C). The measured inductance L, peak quality factor Q, and frequency corresponding to the peak Q are summarized in Table 1 through table 4. The results show that the highest Q value is approximately 10.5 and the corresponding inductance L is about 150 nH. Q peaks at about 330 MHz. The observed Q and L values are deemed adequate for in-vivo measurements of pressure using MEMS based pressure sensors.

Table 5 presents measured resonant frequencies with chip capacitors which represent capacitance values corresponding to pressure changes sensed by MEMS pressure sensors wire bonded to the inductor coil. The results show that for L=150 nH and capacitance in the range of 0.3 to 4.0 pF, the resonant frequency varies from about 670 to 230 MHz which covers the range of interest for in-vivo applications.

Figure 9:
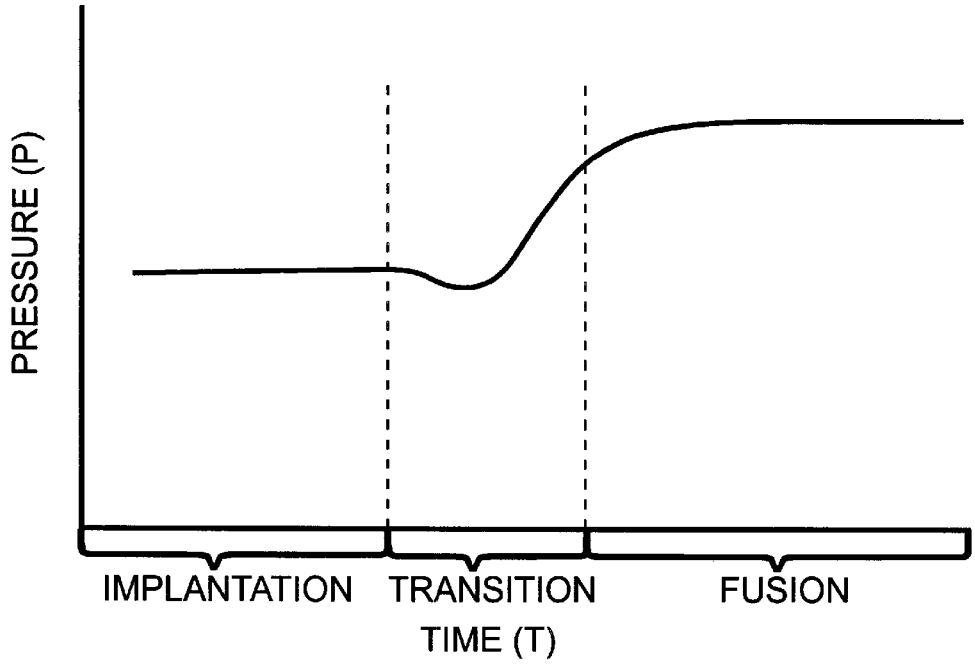
FIG. 9 presents a representative plot of pressure and strain vs. time for a spinal implant typically used in spinal surgery.

Although there are many possible applications for the present invention, it will now be further described in relation to a bio-MEMS, spinal implant, pressure sensor. In a spine fusion operation it is particularly difficult to follow the subsequent progress of the operation and monitor actual loads placed on the implant and bone graft as it heals. External imaging has proven unreliable. A reliable, wireless, telemetry system is particularly needed. FIG. 9 presents a time history of the pressure experienced after a typical spine fusion operation. Of particular note is the history of pressure during the transition time period. During the time of the implantation and transition period, pressure is seen to vary significantly. However, once fusion of the bone graft is completed, the pressure settles down to a constant value as a function of time.

A MEMS implanted device, as illustrated in FIG. 4, is particularly suited as a "smart spinal implant" whereby MEMS chip 36 may be attached to the spine fusion graft using a suitable adhesive. Thus the time progress of the bone graft may be conveniently monitored by merely applying a time varying magnetic field to the implanted chip 36 whereby a RF signal indicating the real time, pressure measurement of the bone graft will be transmitted to and external receiver.

Although the invention has been described in detail with reference to the illustrated embodiments, variations and modifications exist within the scope and spirit of the invention as described and defined in the following claims.

We claim:

1. A microelectromechanical (MEM) radio frequency (RF) transmitting system having no directly connected power source comprising:

a) a planar substrate having a first planar surface and a second parallel opposing surface, said second surface having a cavity etched therein b) a first capacitive plate positioned upon said first surface opposite said cavity, c) a second capacitive plate positioned upon said second surface such that said second capacitive plate extends across the opening of said cavity, e) a planar inductor coil affixed to said first surface whereby said inductor coil circumscribes said first capacitive plate, f) said first and second capacitive plates cooperating with said inductor coil to form a micro-miniature oscillating circuit whereby said microminiature oscillating circuit acts to charge the capacitor formed by said first and second opposing capacitive plates when said inductor coil is subjected to an electromagnetic field and transmits an RF signal when said electromagnetic field is removed, said RF signal being determined by the capacitive value of said capacitor.

2. A microelectromechanical (MEM) radio frequency (RF) transmitting system as claimed in claim 1 wherein said second capacitive plate is circumscribed by a planar ground plane.

3. A microelectromechanical (MEM) radio frequency (RF) transmitting system as claimed in claim 2 wherein said ground plane is serrated.

4. A microelectromechanical (MEM) radio frequency (RF) transmitting system as claimed in claim 1 having an insulating layer between said substrate's first planar surface and said first capacitive plate and said inductor coil.

5. A microelectromechanical (MEM) radio frequency (RF) transmitting system as claimed in claim 4 having an insulating layer between said substrate's second surface and said second capacitive plate.

6. A microelectromechanical (MEM) radio frequency (RF) transmitting system having no directly connected power source comprising:

a) a first planar substrate having a top planar surface and a bottom parallel opposing surface, said top surface having a cavity etched therein, said cavity having an opening in said top planar surface, b) a second planar substrate having a top planar surface and a bottom parallel opposing surface, said bottom surface having a cavity etched therein, said cavity having an opening in said bottom planar surface, c) said first planar substrate overlying said second planar substrate whereby said top surface of said second planar substrate is juxtaposed said bottom surface of said first planar substrate, thereby positioning said cavity in said first planar substrate opposite said cavity of said second planar substrate, e) a first flexible capacitive plate extending over the opening of said cavity of said first planar substrate, f) a second flexible capacitive plate extending over the opening of said cavity of said second planar substrate, g) a third rigid capacitive plate between said first and second planar substrates whereby said third capacitor plate lies between said first and second capacitive plates, h) a planar induction coil between said first and second planar substrates, said planar induction coil encircling said third capacitive plate, i) said first capacitive plate forming a first micro capacitor with said third capacitive plate and said second capacitive plate forming a second micro-capacitor with said third capacitive plate, each of said micro-capacitors forming a first and second oscillator circuit with said induction coil, j) a microprocessor in electrical communication with said first and second micro-capacitors wherein upon electromagnetic activation of said inductor coil, said microprocessor determines the difference C3 between the capacitance of said first and second micro-capacitors, k) said microprocessor in combination with said planar inductor coil forming a micro-miniature RF oscillating circuit whereby said micro-miniature oscillating circuit resonates at a RF frequency proportional to the capacitance value of C3 upon removal of electromagnetic activation.

7. A microelectromechanical (MEM) radio frequency (RF) transmitting system as claimed in claim 6 wherein at least one of said first or second capacitive plates is circumscribed by a planar ground plane.

8. A microelectromechanical (MEM) radio frequency (RF) transmitting system as claimed in claim 7 wherein said ground plane is serrated.

9. A microelectromechanical (MEM) radio frequency (RF) transmitting system as claimed in claim 6 having a an insulating layer between said substrate's top planar surface and said first capacitive plate.

10. A microelectromechanical (MEM) radio frequency (RF) transmitting system as claimed in claim 6 having an insulating layer atop said second substrate's top surface.

11. A microelectromechanical (MEM) radio frequency (RF) transmitting system as claimed in claim 6 having an insulating layer on said second substrate's bottom surface.

* * * * *